United States Patent [19]

Bojsen

[11] 4,277,258

[45] Jul. 7, 1981

[54] ELECTROSTATIC PRECIPITATOR AND DISCHARGE ELECTRODE THEREFOR

[75] Inventor: Erik M. Bojsen, Copenhagen, Denmark

[73] Assignee: F. L. Smidth & Co., Cresskill, N.J.

[21] Appl. No.: 967,513

[22] Filed: Dec. 7, 1978

[30] Foreign Application Priority Data

Dec. 9, 1977 [GB] United Kingdom ..... 51322/77
Nov. 28, 1978 [GB] United Kingdom ..... 42246/78

[51] Int. Cl.[3] ..... B03C 3/41
[52] U.S. Cl. ..... 55/152; 55/153
[58] Field of Search ..... 55/140, 147, 150, 152, 55/153, DIG. 38; 204/288, 289; 361/220, 222; 313/309, 351; 138/177

[56] References Cited

U.S. PATENT DOCUMENTS

| | | | |
|---|---|---|---|
| 1,959,374 | 5/1934 | Lissman | 55/2 |
| 1,962,555 | 6/1934 | Deutsch | 55/2 |
| 1,995,790 | 3/1935 | Anderson | 55/152 |
| 2,129,783 | 9/1938 | Penney | 55/139 |
| 2,251,451 | 8/1941 | Heinrich | 55/2 |
| 2,876,269 | 3/1959 | Tommelstad | 55/150 |
| 2,977,496 | 3/1961 | Doolittle | 313/309 |
| 3,066,463 | 12/1962 | Penney | 55/139 |
| 3,515,939 | 6/1970 | Trump | 55/150 |
| 3,540,994 | 11/1970 | Napier | 55/152 |
| 3,719,031 | 3/1973 | Gelfand | 55/147 |
| 3,747,299 | 7/1973 | Chiang | 55/150 |
| 3,844,742 | 10/1974 | Peterson | 55/112 |
| 3,898,060 | 8/1975 | Starbuck | 55/110 |
| 4,019,538 | 4/1977 | Desse et al. | 138/177 |
| 4,029,485 | 6/1977 | Siwersson et al. | 55/150 |

FOREIGN PATENT DOCUMENTS

| | | | |
|---|---|---|---|
| 500574 | 6/1950 | Belgium | 55/150 |
| 11810 | of 1894 | United Kingdom | 55/150 |
| 487547 | 6/1938 | United Kingdom . | |
| 533198 | 2/1941 | United Kingdom . | |
| 540508 | 10/1941 | United Kingdom . | |
| 553520 | 5/1943 | United Kingdom . | |
| 721358 | 1/1955 | United Kingdom . | |
| 729592 | 5/1955 | United Kingdom . | |
| 842075 | 7/1960 | United Kingdom | 55/152 |
| 998268 | 7/1965 | United Kingdom . | |
| 1198881 | 7/1970 | United Kingdom . | |
| 1243058 | 8/1971 | United Kingdom . | |
| 1308276 | 2/1973 | United Kingdom . | |

*Primary Examiner*—David L. Lacey
*Attorney, Agent, or Firm*—Pennie & Edmonds

[57] ABSTRACT

A discharge electrode is disclosed for producing ion emission in an electrostatic precipitator. The electrode includes a rigid cylindrical tubular member having a plurality of protrusions extending outwardly therefrom. The protrusions preferably have rounded free end portions and are formed either by individual rods integrally attached to the member or by one or more wires attached to the surface of the member and having folds which are selectively spaced apart to provide the desired dispersion of the ion emission. The wires may also be embedded in depressions defined in the surface of the member. The invention also pertains to an improved electrostatic precipitator incorporating the inventive discharge electrode.

19 Claims, 13 Drawing Figures

ELECTROSTATIC PRECIPITATOR AND DISCHARGE ELECTRODE THEREFOR

TECHNICAL FIELD

This invention relates to electrostatic precipitators and more particularly to a rigid tubular discharge electrode member having protrusions united therewith for providing dispersed emissions.

BACKGROUND ART

In electrical precipitators, suspended dust particles or dispersed fluids are removed from a gas stream by first charging the particles and then driving them under the influence of an electrical field to collecting electrodes which may be at ground or another suitable potential with respect to the discharge electrode.

Industrial electrostatic precipitators are used extensively for the removal of solid particles such as fly ash, mineral dust, cement dust, etc., from the gases before they are discharged to the atmosphere in order to protect the surroundings against dust which often is considered a serious nuisance.

It is well known to use discharge electrodes in electrostatic precipitators in the form of wires, rods, bars, tubes, or the like, mounted in rows in a frame between platelike collecting electrodes. However, such supporting frames are subject to lateral vibrations resulting from distortions in the frames during the treatment of hot gases.

Furthermore, tubular discharge electrodes having discharge arms divided into pointed discharge tips are well known. Such discharge electrodes are mechanically stable and can advantageously be used in substantially high electrostatic precipitators without encountering lateral vibrations. However, due to the distribution of the electrical field the discharge tips are exposed to such heavy concentrated charges and emission that the hazard of flashovers is increased. Also, these tips are exposed to electrostatic erosion and thereby are frequently burned away. I have invented an improved discharge electrode which avoids the above-noted limitations of the prior art electrodes.

DISCLOSURE OF INVENTION

A discharge electrode for an electrostatic precipitator which comprises a generally rigid elongated member having a plurality of blunt ended protrusions extending outwardly therefrom and positioned in spaced relation to each other, the blunt ended configuration and spacing of said protrusions providing dispersion of the emission provided by the member.

In particular, the discharge electrode of the present invention provides dispersed ion emission and is in the form of a generally rigid tubular member having a plurality of integral spaced apart protrusions extending outwardly therefrom and transverse to the axis of the member. The free end portions of the protrusions are preferably rounded and the protrusions are suitably spaced from each other to provide dispersion of the electrostatic ion emission.

The present invention makes it possible to obtain a preferred balanced distribution of the ion emission substantially from the total end surfaces of the protrusions. Thus, the danger of arcing is avoided to a large degree. Furthermore, the rounded surfaces are not appreciably exposed to corrosion by electrostatic erosion and the protrusions have a greater mechanical stability.

The discharge electrodes according to the invention can be suitably used in large industrial electrostatic precipitators which require that the distribution of the ionization be uniform and that the electrical field be of a sufficient level to provide for the most efficient precipitation.

The protrusions can be rodlike and can be of various forms. They can be attached to the structure of the tubular member in various manners. In one exemplary embodiment, the protrusions are individual rods attached to the tubular member. In another embodiment, continuous wires attached to the tubular member are bent to form folded portions which result in the rodlike protrusions.

In another exemplary embodiment of the present invention, one or more continuous wires are embedded in channels, such as grooves, depressions, and the like, in the outer wall of the tubular member in a manner such that folds of the continuous wires are positioned in adjacent relation to constitute the rodlike protrusions by compounding the two branches forming a fold to constitute a rod having a rounded surface at its free end.

The present invention also relates to the improved electrostatic precipitator which incorporates the present inventive discharge electrode described herein.

The particular features of the present invention provide preferred balanced ion emission distribution, particularly from the total end surfaces of the protrusions. Thus, the danger of formation of arching is avoided to a high degree. In addition, greater mechanical stability of the discharge electrode is also provided while minimizing electrostatic erosion of the protrusions of the electrode.

BRIEF DESCRIPTION OF THE DRAWINGS

The present invention is described in detail below with reference to the drawings in which.

BEST MODE FOR CARRYING OUT THE INVENTION

Figures 1, 2, 3, 4, 5, 6, 7, 8:
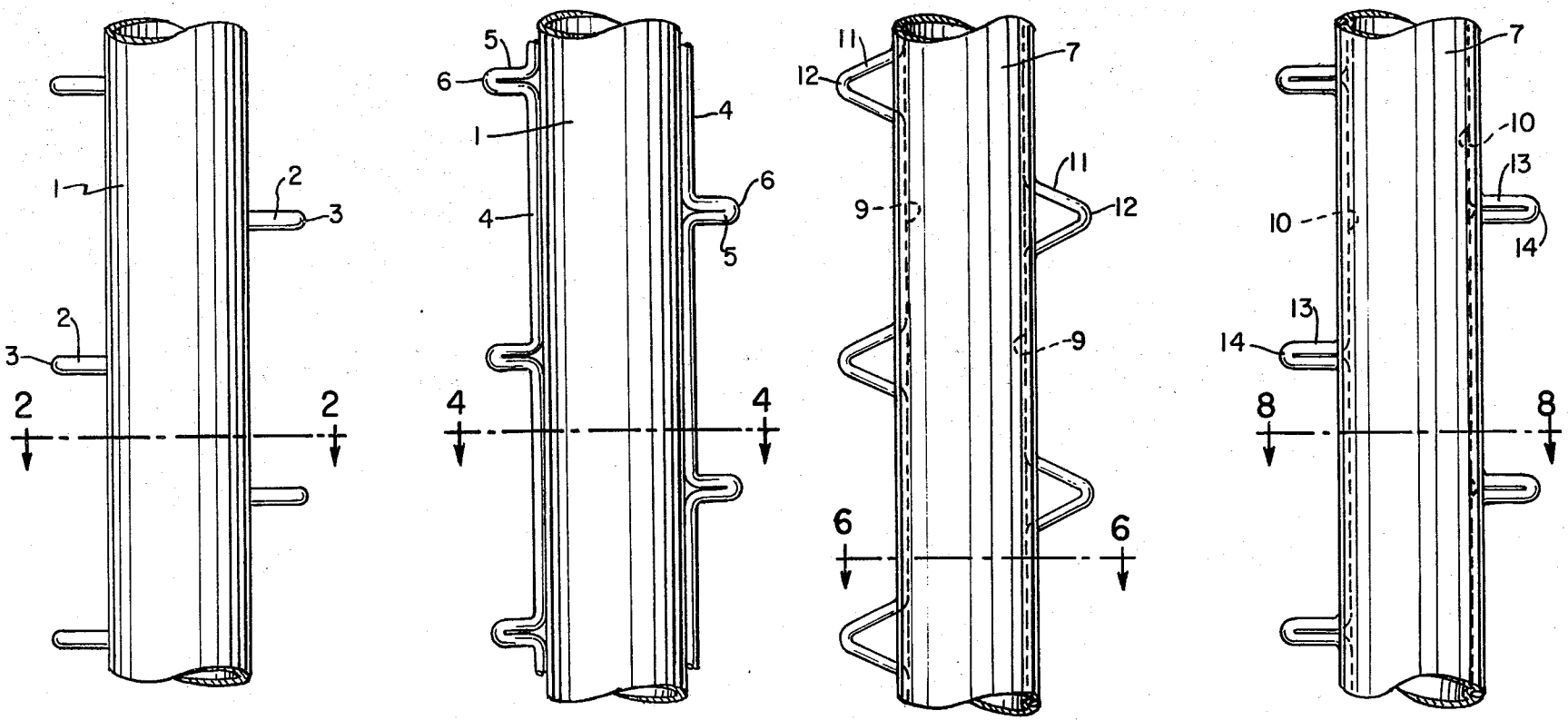
FIG. 1 is a side elevational view of a first exemplary embodiment of a discharge electrode according to the present invention.
FIG. 2 is a cross sectional view of the discharge electrode of FIG. 1 taken along the line 2—2 of FIG. 1.
FIG. 3 is a side elevational view of a second exemplary embodiment of a discharge electrode according to the present invention.
FIG. 4 is a cross sectional view of the discharge electrode of FIG. 3 taken along the line 4—4 of FIG. 3.
FIGS. 5 and 6 and FIGS. 7 and 8 show two additional alternative embodiments of the discharge electrode of FIG. 3.

Referring to FIGS. 1 and 2, a discharge electrode is shown as a tube 1 having integral rodlike protrusions 2 and rounded end surfaces 3.

In FIGS. 3 and 4 the tube 1 is shown having wires 4 having windings which form protrusions 5. At selected positions of the wire 4 folds are made which serve as protrusions 5 having rounded end surfaces 6.

In FIGS. 5, 6, 7 and 8, a modified tubular structure 7 is shown with longitudinal depressions 8 in the surface of the tube 7. Wires 9, 10 are embedded in the depressions 8. The wire 9 in FIGS. 5 and 6 is formed with inverted V-shaped folded-wire protrusions 11 having rounded end surfaces 12. The wire 10 in FIGS. 7 and 8 is formed to provide rodlike protrusions 13 having rounded end surfaces 14.

In the exemplary embodiment illustrated in FIGS. 1 and 2 the individual rodlike protrusion may be joined to the tube 1 in a known manner such as by welding. The surface of the tubular structure 1 itself is substantially smooth such that when a high voltage is applied to the discharge electrode a uniform electrical field is created around the tubular structure 1, and a concentrated electrical field is established at the rounded end surfaces 3 of the rodlike protrusions 2. As a result of the concentrated electrical field, clouds of ions are emitted in a dispersed manner. However, the rounded end surfaces 3 spread the discharge without giving rise to arcing. Thus, the charging of the dust is greatly improved which results in an increased efficiency in the precipitating of the solid particles.

In the second exemplary embodiment illustrated in FIGS. 3 and 4, the rodlike protrusions 5 are made by the windings (or folds) of the wires 4 attached to the tube 1. This construction is very simple to manufacture. Moreover, the rodlike protrusions 5 are interconnected by the wires 4 so that a single rodlike protrusion 5 cannot be knocked off or burned off by accident.

In the alternative exemplary embodiments shown in FIGS. 5, 6, 7 and 8, the tubes 7 are provided with depressions 8 to receive the wires 9, 10. In this fashion, only the protrusions 11, 13 project from the surface of the tubes 7, thereby ensuring that the surface of the tube 7 is substantially uniform. This construction eliminates the need to position the wires 9, 10 along the surface of the tube 7, and further reduces the possibility of uncontrolled discharge. Furthermore, it is ensured that the wires 9, 10 do not cause dust to accumulate on the tubular discharge electrode which could otherwise destroy the preferred distribution of the electrostatic field.

The structuring of the rodlike protrusions 2, 5, 11, 13, i.e., the diameter of the wire 9, 10, the intervals between the rodlike protrusions 2, 5, 11, 13, their length, etc., depends upon the preferred distribution from the discharge electrode.

Preferably, the protrusions 2, 5, 11, 13 extend from the surface of the tube a distance of at least one-tenth of and up to the diameter of the tube 1, 7. Additionally, the protrusions 2, 5, 11, 13 are successively spaced apart at intervals extending from a distance at least equal to and up to twenty times the length of the protrusions 2, 5, 11, 13.

Figure 10:
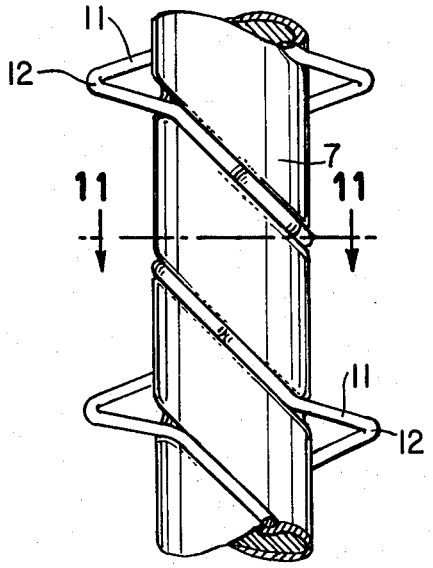
FIG. 10 is a side elevational view of a a fifth exemplary embodiment of a discharge electrode according to the present invention.
Figure 12:
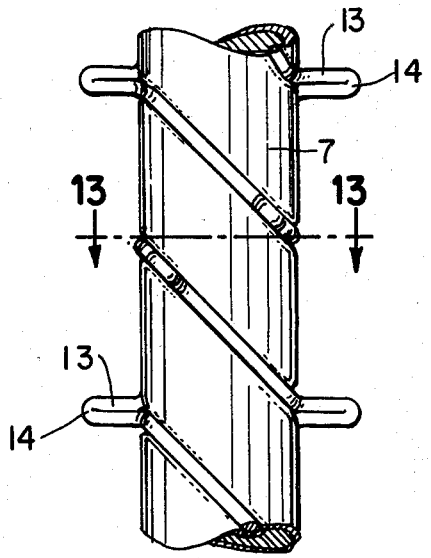
FIG. 12 is a side elevational view of a sixth exemplary embodiment of a discharge electrode according to the present invention.

The depressions 8 may alternatively be either helical to, as illustrated in FIGS. 10 and 12, or they may be disposed in a plane transverse to, the axis of the tube 7. In a preferred embodiment, the depressions 8 have a depth approximately equal to the diameter of the wire 9, 10 whereby the surface of the tube 7 is kept substantially smooth so as to provide a uniform electrical field upon the application of a high voltage to the discharge electrode.

Figure 9:
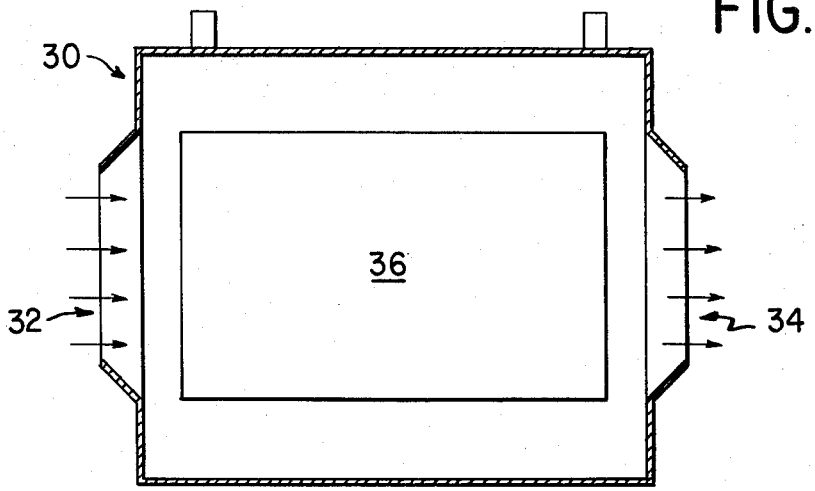
FIG. 9 is a cut-away view of a portion of an electrostatic precipitator according to the present invention in which the inventive discharge electrodes are housed.

A portion of an electrostatic precipitator 30 is shown in FIG. 9. The electrostatic precipitator 30 includes an inlet 32 and an outlet 34. A plurality of discharge electrodes 36 according to the present invention as schematically shown can be suspended within the electrostatic precipitator 30.

Figure 11:
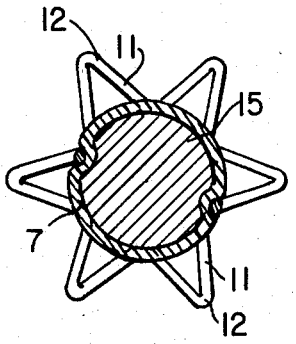
FIG. 11 is a cross sectional view of the discharge electrode of FIG. 10 taken along the line 11—11 of FIG. 10.
Figure 13:
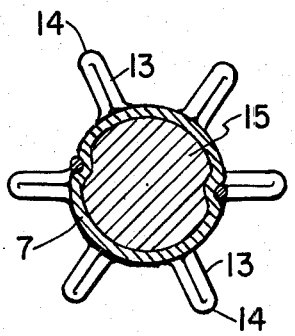
FIG. 13 is a cross sectional view of the discharge electrode of FIG. 12 taken along the line 13—13 of FIG. 12.

When the electrostatic precipitators are of a substantial height, the mechanical vibrations in the long tubular structures may be controlled by loading the tubes. One method of loading is to insert weights preferably in the form of columns of gravel 15, as illustrated schematically in FIGS. 11 and 13, inside the discharge electrode at positions where the weight will suppress any mechanical vibrations by absorbing energy during such movements.

I claim:

1. A discharge electrode for ion emission in an electrostatic precipitator which comprises a generally rigid tubular member including at least one channel along the surface thereof, at least one wire member disposed within said at least one channel, said at least one wire member being selectively folded at spaced portions along said generally tubular member to form a plurality of spaced apart, generally elongated protrusions having blunt ended portions, said protrusions extending outwardly therefrom and generally transverse to the axis of said member, at least one of said protrusions having a free end portion having a generally rounded configuration, said protrusions being configured and spaced such that the dispersion of the electrostatic ion emission provided by said member is substantially uniform and substantially from the blunt ended portions of said protrusions.

2. The discharge electrode according to claim 1 wherein said generally tubular member has a generally cylindrical configuration and said protrusions have a rodlike configuration.

3. The discharge electrode according to claim 2 wherein each of said protrusions is secured to said tubular member.

4. The discharge electrode according to claim 2 wherein each of said protrusions has a generally rounded free end portion.

5. The discharge electrode according to claim 4, wherein each of said at least one channel is in the form of a depression in the wall of said tubular member and has a depth approximately equal to the diameter of said wire disposed therein.

6. The discharge electrode according to claim 5 wherein the wall of said tubular member comprises at least two depressions and at least one wire member is positioned in each depression, each wire member being folded at spaced positions along said tubular member to define said protrusions.

7. The discharge electrode according to claims 5 or 6 wherein each depression is substantially parallel with the longitudinal axis of said generally tubular member.

8. The discharge electrode according to claim 6 wherein each depression has a generally helical configuration and extends about the longitudinal axis of said generally tubular member.

9. The discharge electrode according to claims 1, 4, or 6 wherein said protrusions extend generally transverse to the axis of said tubular member and are successively spaced apart at least a distance equal approximately to one-tenth of the diameter of said tubular member.

10. The discharge electrode according to claim 9 wherein said protrusions extend from the surface of said tubular member a distance up to approximately the diameter of the tubular member.

11. The discharge electrode according to claims 1, 4, or 6 wherein said protrusions are successively spaced apart at least a distance equal approximately to the length of the protrusion measured from the surface of said tubular member.

12. The discharge electrode according to claim 11 wherein said protrusions are successively spaced apart a distance up to approximately twenty times the length of the protrusion from the surface of the tube.

13. The discharge electrode according to claims 1, 4, or 6 further comprising means positioned internally of said tubular member for increasing the rigidity of said tubular member so as to suppress mechanical vibrations thereof.

14. The discharge electrode according to claims 1, 4, or 6 wherein said protrusions are disposed substantially in the same plane.

15. The discharge electrode according to claim 14 wherein said plane is parallel to at least one plane containing the longitudinal axis of said member.

16. The discharge electrode according to claim 4 wherein each channel is in the form of a depression in the wall of said tubular member and lies in a plane transverse to the longitudinal axis of said tubular member.

17. The discharge electrode according to claim 4 wherein each folded portion of at least one wire member comprises at least two branches positioned in adjacent relation to constitute a compound protrusion extending outwardly from said tubular member.

18. A discharge electrode for electrostatic ion emission in an electrostatic precipitator adapted to provide high potential electrostatic impulses, which comprises a generally rigid generally tubular member including at least one channel and at least one wire member disposed within each channel, said at least one wire member being selectively folded at spaced portions along said generally tubular member to form a plurality of spaced apart protrusions extending outwardly therefrom and generally transverse to the longitudinal axis of said member, each protrusion having a free end portion having a generally rounded configuration such that the spacing of said protrusions and the generally rounded configuration of the free end portions thereof provide substantially uniform dispersion of the electrostatic ion emission provided by said member.

19. In an electrostatic precipitator adapted to provide a generally unidirectional electrostatic field generated by a high unidirectional voltage and an ionization field generated by an impulse voltage for removal of particulates suspended in gases directed therethrough of the type having at least one discharge electrode for ion emission, the improvement wherein said at least one electrode is in the form of a generally rigid tubular member including at least one channel and at least one wire member disposed within each channel, said at least one wire member being selectively folded at spaced portions along said generally tubular member to form a plurality of uniformly spaced protrusions extending outwardly therefrom and extending generally transverse to the axis thereof, each protrusion having a free end portion having a generally rounded configuration such that the uniform spacing of said protrusions and the generally rounded configuration of the protrusions provide dispersion of electrostatic ion emission substantially from the generally rounded free end portions of said member.

* * * * *

UNITED STATES PATENT AND TRADEMARK OFFICE

CERTIFICATE OF CORRECTION

PATENT NO. : 4,277,258

DATED :

INVENTOR(S) : ERIK MOE BOJSEN

It is certified that error appears in the above—identified patent and that said Letters Patent is hereby corrected as shown below:

On the cover sheet priority data "42246/78" should read -- 46246/78 --.

In Column 2, line 31, "arching" should be --arcing--.

Signed and Sealed this

*Thirteenth* Day of *October 1981*

[SEAL]

*Attest:*

GERALD J. MOSSINGHOFF

*Attesting Officer*

*Commissioner of Patents and Trademarks*